US005316138A

United States Patent [19]

Thompson

[11] Patent Number: 5,316,138

[45] Date of Patent: May 31, 1994

[54] CARPET DISPLAY SAMPLE KIT

[75] Inventor: Carl D. Thompson, Lagrange, Ga.

[73] Assignee: Milliken Research Corporation, Spartanburg, S.C.

[21] Appl. No.: 11,875

[22] Filed: Feb. 1, 1993

[51] Int. Cl.[5] ..... B65D 85/62

[52] U.S. Cl. ..... 206/223; 206/45.14; 206/450; 206/472; 206/564

[58] Field of Search ..... 206/45, 45.14, 45.19, 206/45.28, 81, 223, 425, 449, 455, 472, 450, 560, 561, 564; 211/45

[56] References Cited

U.S. PATENT DOCUMENTS

| | | | |
|---|---|---|---|
| Re. 33,503 | 12/1990 | Schluger . | |
| 395,048 | 12/1888 | Goff | 206/450 |
| 958,218 | 5/1910 | Benze . | |
| 1,465,827 | 8/1923 | Kunkel | 206/425 |
| 1,978,925 | 10/1934 | Williams | 206/449 |
| 3,672,490 | 6/1972 | Desmarais et al. | 206/456 |
| 3,755,925 | 9/1973 | Court . | |
| 4,193,652 | 3/1980 | Brown, Jr. . | |

FOREIGN PATENT DOCUMENTS

| | | | |
|---|---|---|---|
| 905374 | 12/1945 | France . | |
| 2502928 | 10/1982 | France | 211/45 |

*Primary Examiner*—Jimmy G. Foster
*Attorney, Agent, or Firm*—T. T. Moyer; E. R. Marden

[57] ABSTRACT

A carpet sample display kit having a carpet sample display rack mounted therein which supports carpet samples at an angle to the viewer to provide an efficient view of the carpet samples. The carpet rack has a plurality of spaced support members mounted at an angle to hold carpet samples therebetween with the help of a bent portion at the top thereof.

4 Claims, 1 Drawing Sheet

CARPET DISPLAY SAMPLE KIT

This invention relates to a kit to effectively display fabric samples and in particular, carpet samples of varying colors with various design features.

Numerous kits have been designed to display fabrics such as carpet samples or tiles, but most do not allow the viewer to see an array of colors in such a small, approximately 10"×10" space, nor do they allow viewing at an angle but in a flat position requiring substantially more viewing space.

Therefore, it is an object of the invention to provide a carpet display sample kit in which the samples are readily visible and can be easily moved and/or replaced with a minimum of effort.

Figure 1:
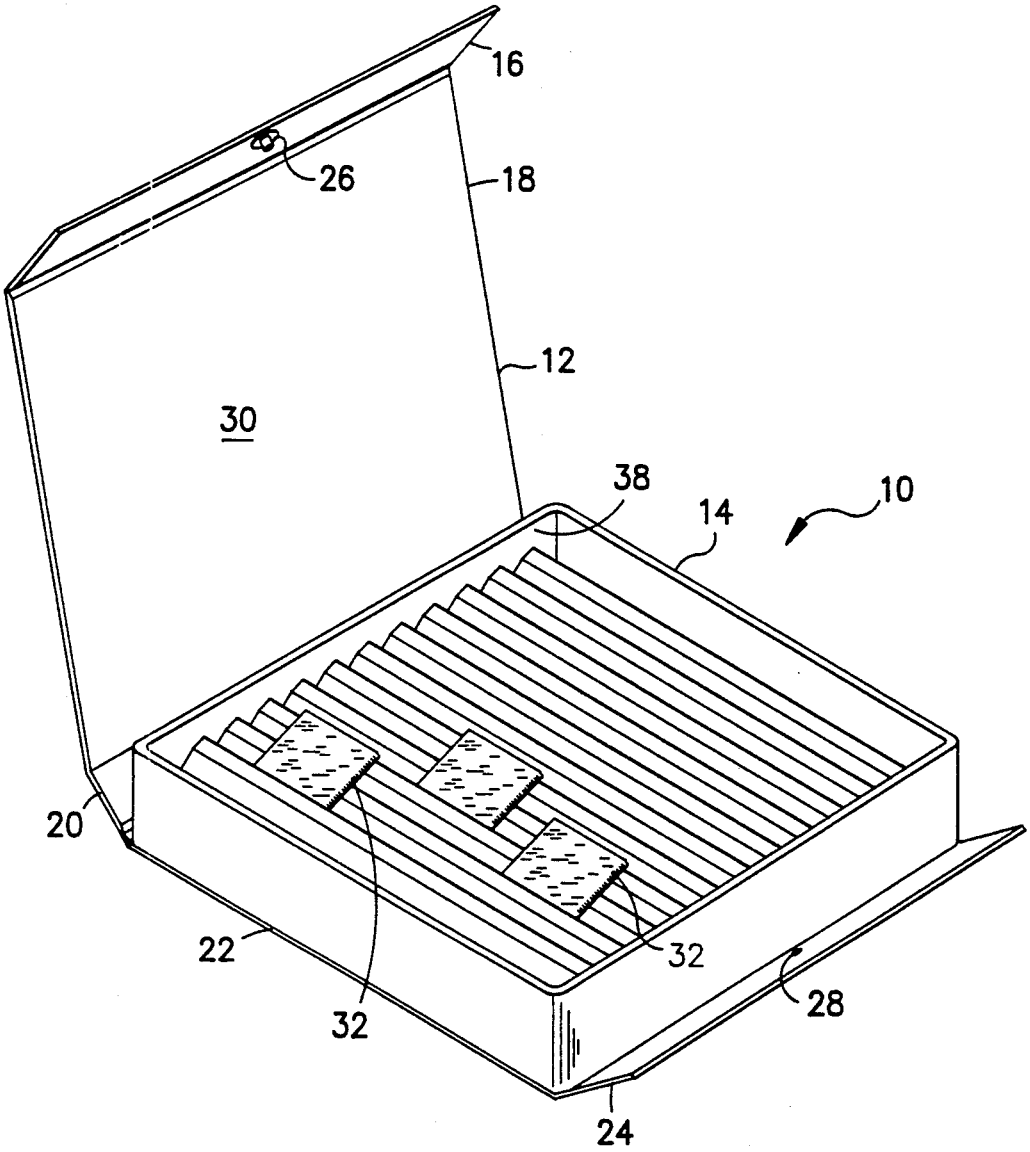
Figure 2:
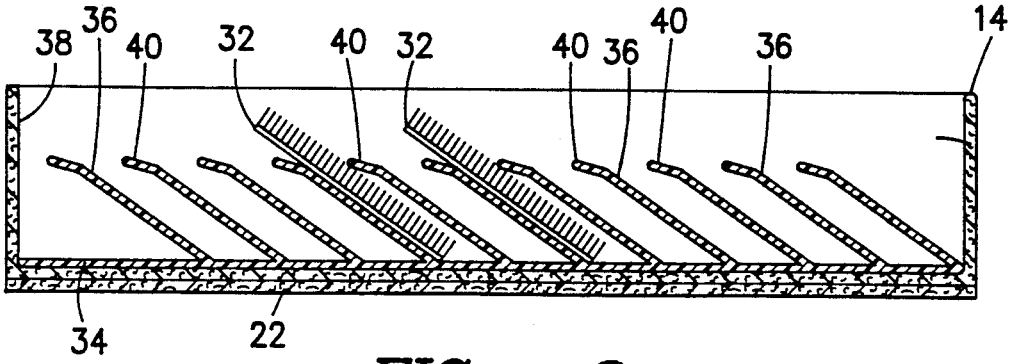

Other objects and advantages of the invention will become readily apparent as the specification proceeds to describe the invention with reference to the accompanying drawing, in which:

FIG. 1 is a perspective view of the new and improved carpet display kit, and FIG. 2 is a cross-section view of the carpet sample tray shown in FIG. 1.

Looking now to FIG. 1 the carpet display kit 10 basically consists of a binder 12 of covered cardboard or other desired material and a carpet display tray 14 of cardboard, plastic, etc. adhered to the binder 12 by a suitable adhesive such as glue.

The binder 12 is designed to have five portions, namely 16, 18, 20, 22 and 24. The binder portions 16, 20 and 24 are about the same width with portion 16 having a lock pin 26 or other suitable means such as a magnet to engage the grommet or magnet 28 in the portion 24 to hold the display kit closed. The portion 20 is a width a little larger than the length of the display tray 14 to allow the portion 18 to overlie and cover the tray 14. It is contemplated that advertising material and/or brochures will be mounted on the inside face 30 of the binder portion 20 to allow the viewer to understand and evaluate the carpet samples 32 in the tray 14. Product specifications and other information will be printed on back side of sample box.

The sample tray 14 is preferably square and is adhered to the binder portion 22 by a suitable adhesive, but obviously could be rectangular or other shapes depending on the desires of displayer. Mounted within the confines of the tray is a display rack 34 of plastic or other suitable material to support the samples 32 for display. In the preferred form of the invention the samples 32 are two inch squares of carpet of various colors and/or designs which are placed between the angled support members 36. The support members 36 are mounted at an angle of approximately 65% to the side walls 38 of the tray 14 with the outer tip 40 thereof bent towards the next adjacent support member to lightly engage the surface of the sample 32. The particular angle of bending depending on the size of the sample to be displayed. The upper surface of bent outer tip 40 is used to identify the particular samples by style number, color, etc. The depth of the sample to be displayed determines the spacing between adjacent support members 36. As can be seen in FIG. 2 the height of the support member 36 is determined by the size of the sample 32 to be displayed so that the upper portion of the sample is at an angle to and projects above the support member 36.

As described above, a carpet sample display kit has been provided which is compact, provides effective viewing by a customer and in which carpet samples can be readily removed and replaced. Furthermore, the construction of the carpet sample tray is such that the samples remain in the preselected condition when the display kit is closed and transported or even when opened and turned upside down.

Other advantages are apparent and it is understood that changes may be made within the scope of the invention and therefore it is requested that the invention be restricted only by the scope of the claims.

I claim:

1. A carpet sample display kit comprising: a binder and a carpet display tray mounted on said binder, said binder enveloping said display tray and having a means to maintain it closed around said display tray, said tray having four interconnected walls and a bottom, a display rack within said four walls and resting on said bottom, said display rack having a plurality of spaced support members spaced from one another and located at an acute angle to two of said interconnected walls, said support members having a means to support carpet samples therebetween.

2. The display kit of claim 1 wherein said means to support carpet samples being the end portion of said support members being bent out of the plane of the support members and towards the next adjacent support member.

3. The display kit of claim 2 wherein the support member is at an angle of approximately 65° to said two wall members.

4. The display kit of claim 3 wherein the support member is at an angle of approximately 65° to said two wall members.

* * * * *